US006563426B2

(12) United States Patent
Herzberg

(10) Patent No.: US 6,563,426 B2
(45) Date of Patent: May 13, 2003

(54) WARNING METHOD AND APPARATUS

(75) Inventor: Louis P. Herzberg, Monsey, NY (US)

(73) Assignee: International Business Machines Corp., Armonk, NY (US)

( * ) Notice: Subject to any disclaimer, the term of this patent is extended or adjusted under 35 U.S.C. 154(b) by 0 days.

(21) Appl. No.: 09/845,005

(22) Filed: Jul. 3, 2001

(65) Prior Publication Data

US 2003/0006898 A1 Jan. 9, 2003

(51) Int. Cl.[7] ..... G08B 23/00

(52) U.S. Cl. ..... 340/573.1; 340/407.1; 340/825.19; 434/112

(58) Field of Search ..... 340/573.1, 692, 340/539, 825.19, 407.1, 5.1, 5.2, 5.22, 540, 541, 565; 434/112, 114

(56) References Cited

U.S. PATENT DOCUMENTS

| | | | | | |
|---|---|---|---|---|---|
| 4,025,922 | A | * | 5/1977 | Trawick, III | 342/24 |
| 4,853,674 | A | * | 8/1989 | Kiss | 340/407.1 |
| 5,019,802 | A | * | 5/1991 | Brittain et al. | 340/522 |
| 5,508,699 | A | * | 4/1996 | Silverman | 340/944 |
| 5,515,026 | A | | 5/1996 | Ewert | 340/436 |
| 5,572,201 | A | | 11/1996 | Graham et al. | 340/902 |
| 5,682,882 | A | | 11/1997 | Lieberman | 128/630 |
| 5,825,283 | A | | 10/1998 | Camhi | 340/438 |
| 5,838,238 | A | | 11/1998 | Abita et al. | 340/573.1 |
| 5,877,695 | A | | 3/1999 | Kubes et al. | 340/815.4 |
| 5,892,447 | A | | 4/1999 | Wilkinson | 342/573.4 |
| 5,933,082 | A | * | 8/1999 | Abita et al. | 340/541 |
| 5,936,528 | A | * | 8/1999 | Kobayashi et al. | 340/572.5 |
| 5,986,786 | A | * | 11/1999 | Crandall, Jr. et al. | 359/154 |
| 6,021,177 | A | | 2/2000 | Allport | 379/48 |
| 6,028,514 | A | | 2/2000 | Lemelson et al. | 340/539 |
| 6,154,139 | A | * | 11/2000 | Heller | 340/573.4 |

* cited by examiner

*Primary Examiner*—Toan Pham
(74) *Attorney, Agent, or Firm*—Louis J. Percello; Charles W. Peterson, Jr.

(57) ABSTRACT

This invention provides methods and apparatus for a special object such as a handicapped individual and/or special equipment with access to and from telecommunications and computer controlled equipment. The equipment being such as to let it be known of the special object being in a particular moving or still environ, and requiring special attention from and/or by others entering or located in that environs The special object, handicapped person or special equipment is made known to those in the environ so as to protect/preserve/serve that object, individual, special equipment, and/or to others entering or located in that environ. The equipment transmits an alarm type signal that a handicapped individual or special equipment is in the environ. The computerized apparatus/method being adapted to be responsive to particular sensations, seeing, hearing, feeling, smelling, etc., which are operational in the particular handicapped individual. The special object has a level of bi-directional interactivity with their environ and/or those responsible for the environ and/or the special object via the computerized telecommunications apparatus/method.

17 Claims, 4 Drawing Sheets

WARNING METHOD AND APPARATUS

FIELD OF THE INVENTION

This invention is directed to the field of computerized warning systems. It is more particularly directed to providing information regarding the presence of a special object in an environ.

BACKGROUND OF THE INVENTION

A handicapped individual or special equipment (containing medical or radioactive material and/or, waste, ambulance, police vehicle, fire vehicle) needs access to telecommunications and computer controlled equipment to let it be known of their being in a particular moving or still environ, and require special attention from [and/or by] others entering (or located in) that environ. Similarly environs and/or objects in a particular environ have to be protected from objects that enter that environ to which the environs and/or objects are sensitive. In some situations both the entering object and the environ both have mutual protection.

Various apparatus have been proposed to provide general warning alarms and notification. But these do not enable the handicapped person to let these situations be known to those in the environ so as to protect/preserve/serve that individual, special equipment and/or the others entering (or located in) that environ, and/or to let the environs and/or an object in the environ know that an object to which it is sensitive is entering or is in that environ.

For example, Ewert's invention U.S. Pat. No. 5,515,026 provides an animal collision avoidance system for vehicle accident prevention. It uses electromagnetic transmissions for alerting drivers to unanticipated accident threats such as pedestrians, bicyclists, complete joggers, emergency vehicles, disabled vehicles, and alerts pedestrians that the vehicle is approaching thereby inducing them to move to the side of the road. It further transmit a preprogrammed array of natural sounds to induce animals and people to vacate the path of the approaching vehicle.

Graham et al., in U.S. Pat. No. 5,572,201, provide a broadcasting [alerting] apparatus to broadcast a visual and audible warning in an area about a site employing RF links without dedicated receivers. It warns of an emergency situation having a transmitter responsive to a visual or acoustic alerting system for transmitting an alarm signal on an RF carrier and a control signal on a sideband, preferably in commercial broadcast band transferring from a normal operating mode transfers to an emergency mode upon detection of the control signal and converts the alarm signal to an acoustic signal.

Lieberman in U.S. Pat. No. 5,682,882 provides a human subject vigilance, (activity and alertness) monitor having ambient sensors and being adapted to detect the human subject response to the stimuli, and a controller programmed to receive information from the environmental or ambient sensors, to control the stimulators and record the human subject's response to the stimuli via the human response sensors.

Lemelson et al., in U.S. Pat. No. 6,028,514 provides a system/apparatus for monitoring a geographic person location, periodically warning a person of emergency situations in the geographic location, and transmitting requests for assistance in emergency situations. The system/apparatus employ a geographic satellite receiver, a receiver circuit to receive broadcast warning signals defining dangerous situations and geographic locations of the situations, a computer controller, an alarm indicator, and a transmission circuit to generates and transmits signals requesting assistance, a detailed command center to monitor and communicate with the person using it.

Allport in U.S. Pat. No. 6,021,1777 provides a community alarm and notification apparatus employing the telephone line communications system and device for providing a notification or warning of pending or imminent danger to the public via a warning signal and geographic coverage for such signal. The apparatus is coupled to individual telephone lines within homes and businesses. It monitors the telephone line for specific codes, and is activated upon receipt of such codes.

Wilkinson in U.S. Pat. No. 5,892,447 provides a battery operated warning system to a person about proximity of a particular other (threatening) person. Kubes et al., provide in U.S. Pat. No. 5,877,695 a visual alarm employing an organic electroluminescent material sealed within a portable radio telephone along with the control grids to cause the material to luminesce in a pixilated pattern in response to an alarm message.

Cambhi in U.S. Pat. No. 5,825,283 provides apparatus for monitoring subjects and vehicles which have location determining device which provides the location of the subject to a processor with respect to predefined safety or security related limits including geographical boundaries, and to alert concerned individuals so that proper corrective action may be taken. The apparatus may be configured to provide interactivity with the user to allow user correction of adverse conditions.

Abita et al., in U.S. Pat. No. 5,838,238 provides a transportation system apparatus to assist blind or visually impaired travelers that they have entered a potentially dangerous area proximal to an edge of boarding platforms of the type typically found in railway and other types of transit systems. It employs an Infrared Integrated Indicating System with an array of optical emitters and a portable detector/warning device to be held by a visually handicapped traveler and a second indicator to provide confirmation to the visually handicapped traveler that doors are open as he or she prepares to board. These above described prior inventions are not related to provide general often bi-directional protection to individuals, generally, and/or handicapped persons employing sensation alarms, and/or to protecting hazardous material as in the present invention.

It would also be advantageous to have a means to enable the handicapped person or special equipment to let these situations be known to those in the environ so as to protect/preserve/serve that individual, special equipment and/or the others or other objects entering (or located in) that environ.

SUMMARY OF THE INVENTION

It is therefore an aspect of the present invention to present methods and apparatus to provide for a special object such as a handicapped individual and/or special equipment (containing medical or radioactive material and/or waste, ambulance, police vehicle, fire vehicle) with access to telecommunications and computer controlled equipment. The equipment being such as to let it be known of the special object being in a particular moving or still environ, and requiring special attention from [and/or by] others entering (or located in) that environ. In another aspect of the invention, the methods and apparatus enable the handicapped person or special equipment to let their special situations be known to those in the environ so as to protect/preserve/serve that individual, special equipment and/or the others entering (or located in) that environ.

In another aspect of the invention, a computerized transmitting telecommunications apparatus is made available to the handicapped individual [or special equipment] which transmits an alarm type signal that a handicapped individual [or special equipment] is in the environ. The signal is transmitted to (or for the use of) others entering (or located in), or responsible for that environ. The computerized apparatus/method being adapted to be responsive to particular sensations, [seeing, hearing, feeling, smelling] which are operational in the particular handicapped individual. In some case the special object [handicapped individual] may have a level of (bi-directional) interactivity with their environ and/or those responsible for the environ and/or the special object via the computerized telecommunications apparatus/method.

In still another aspect of the invention, a recipient of the information has cooperative equipment to seek, receive and react to the information in manners that respond to the special object and/or the phenomenon in the information causing the need for a response.

In an alternative aspect, the invention provides cell phone control for enabling, restricting, inhibiting and re-enabling cell phone use in an environ.

In a further aspect of the invention, to provide for responding to a phenomenon by temporarily restricting the cause of a unwanted, dangerous and/or undesirable situation or restricting the special object in accordance with a priority policy Other objects and a better understanding of the invention may be realized by referring to the detailed description.

BRIEF DESCRIPTION OF THE DRAWINGS

These and other aspects, features, and advantages of the present invention will become apparent upon further consideration of the following detailed description of the invention when read in conjunction with the drawing figures, in which:

FIG. 4(*b*) shows an example of an expanded method step of the method in FIG. 4(*a*).

DESCRIPTION OF THE INVENTION

The present invention provides methods and apparatus for computerized transmitting telecommunications apparatus made available to a handicapped individual, object, or special equipment which transmits an alarm type signal that a handicapped individual, object [or special equipment] is in the environ. The signal is transmitted to, or for the use of, others entering located in, and/or responsible for that environ. The computerized apparatus/method being adapted to be responsive to and/or with particular sensations, [seeing, hearing, feeling, smelling] which are operational in the particular handicapped individual. In some cases the handicapped individual may have a level of (bi-directional) interactivity with their environ via the computerized telecommunications apparatus/method. In some embodiments, a safety feature is often included which does not allow an alarm to be overridden or voided except by special means and/or by specially authorized individuals.

As used herein the handicapped individual or any individuals or group of person, objects, and/or special equipment is collectively referred to as the 'special object. Special objects include one or more people, animals, hazardous or sensitive material and/or equipment. The presence of the special object in particular environ is made known to provide the aspects of the present invention. In some applications the invention is used to protect the special object in the environ, in other cases the environ or objects in the environ are protected from the special object and/or a combination of these.

The term special object is sometimes referred to herein as a sensitive entity. In some cases a dangerous phenomenon causes the termination of one or more other non-otherwise related entitles or functions. For example, excavation, blasting, signal generation, and/or chemical emission in the environ is temporarily terminated till a truck, train, ships, helicopter or other plane carrying radioactive, chemical, sensitive equipment safely enters and leaves that environ.

Figure 1:
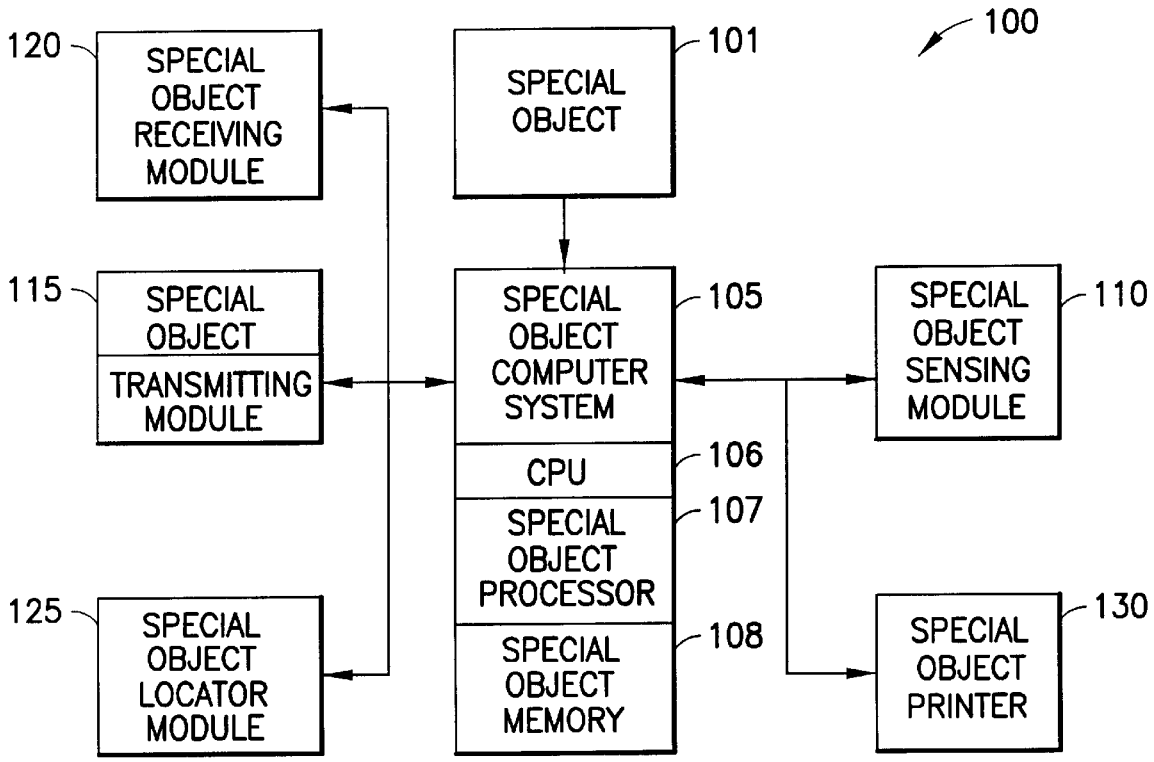
FIG. 1 shows a generalized embodiment of a special object apparatus 100 in accordance with the present invention.

FIG. 1 shows a generalized embodiment of a special object apparatus 100 in accordance with the present invention. It shows the special object 101 coupled to a special object computer 105 having a CPU 106, special object processor 107, and special object memory 108. The computer is coupled to a special object sensing module 110, an special object transmitting module 115, and a special object receiving module 120. In some cases the special object apparatus 100 includes a special object locator module 125, and/or a special object printer 130.

In many embodiments, the special object receiving module 110 includes a special object antenna (not shown), and/or one or more special object sensory sensor (also not shown). A special object sensory sensor senses such things as audio, visual, tactile, and/or olfactory etc. occurrences, alarms and/or indicators.

In many embodiments, the special object transmitting module 115 includes a special object transmitting antenna (not shown) and/or a special object sensory transmitter (also not shown). The sensory transmitter transmits audio, visual, tactile, pressure, electrical, electromagnetic and/or olfactory alarms and/or indicators.

When used, the special object locator module 125, generates and/or receives geographic location data of the location of the special object, the location data is used by the special object processor 107 to indicate the location of the special object to interested parties and/or equipment as the situation warrants. The location module 125 may include a Global Positioning System (GPS) or LORAN location determination capability, and/or receive location data from a location indicating device situated in particular environs providing location and/or other descriptive [e.g. Postal or e-mail address] data.

The special object memory includes information used by the processor 107 to determine import of a reportable phenomenon and reaction protocol. It sometimes also stores information about the special object which is used in reacting to the phenomenon. For example, when the special object is a handicapped individual, the memory stores and makes available descriptive and medical data regarding the individual, i.e. medical problems, medication used and/or allergies etc.

When in an activated state, the special object receiving module 110 upon receiving an input of interest or import to the special object 101, and/or environ forwards the signal to the special object processor 107 for processing and determination of the reaction to take to protect the special object from the environ and/or the environ from the special object 101. If the situation requires an output, the special object processor 107, causes the special object transmitting module 115 to transmit an alarm, and/or a signal to the environ. In some situations the transmitting module outputs an audible, visual, electrical, electromagnetic and/or olfactory sensory alarm.

The alarm is sent to the special object, the environ, protective agencies and/or a combination of these. Thus for example when the special object is blind, and/or deaf individual, that individual is apprised of the alarm causing situation by smelling the olfactory alarm or a specialized tactile [specially textured] or pressure alarm [tugging the handicapped persons arm or other body part.]. Severity of the alarm is sometimes indicated by the volume, display size, electrical signal magnitude, and/or odor intensity and/or alarm repetition. Some alarms have special requirements for being disabled and/or terminated. Other alarms are sometimes generated in response to a lack of indicated resolution of the alarming situation.

In some embodiments, the special object automatically and/or manually triggers an alarm in response to a particular phenomenon, e.g. criminal activity, dangers felt or pending, fire, smoke, carbon monoxide, odors etc.

In some embodiments, the special object automatically and/or manually triggers an alarm in response to a particular phenomenon, e.g. criminal activity, dangers felt or pending, fire, smoke, carbon monoxide, odors etc.

In some embodiments the olfactory alarm emits a particular odor in correspondence to a particular type of situation and/or a particular type of evasive action to take. For example an odor of something burning indicates an explosion or fire emergency, [go outdoors]. A mercaptan odor indicates an unsafe gas or chemical emergency, [go indoor or outdoor as the situation warrants]. Other generally profuse odors are used to indicate magnetic field or radiation emergency, etc. In some embodiments, one or more pleasant odors or fragrances are emitted to indicate the end of an alarming condition.

In some cases the alarm indicates the type of evasive action the special object, protection providing services [police, medical, fire], and/or the environ should take. For example, the special object would be notified to stay put, go indoors, go outdoors, change route, help is on its way, and/or the danger is being temporarily terminated, etc.

When a special object printer 130 is used the printer outputs information regarding the special object and/or the phenomenon causing an alarm.

Figure 2:
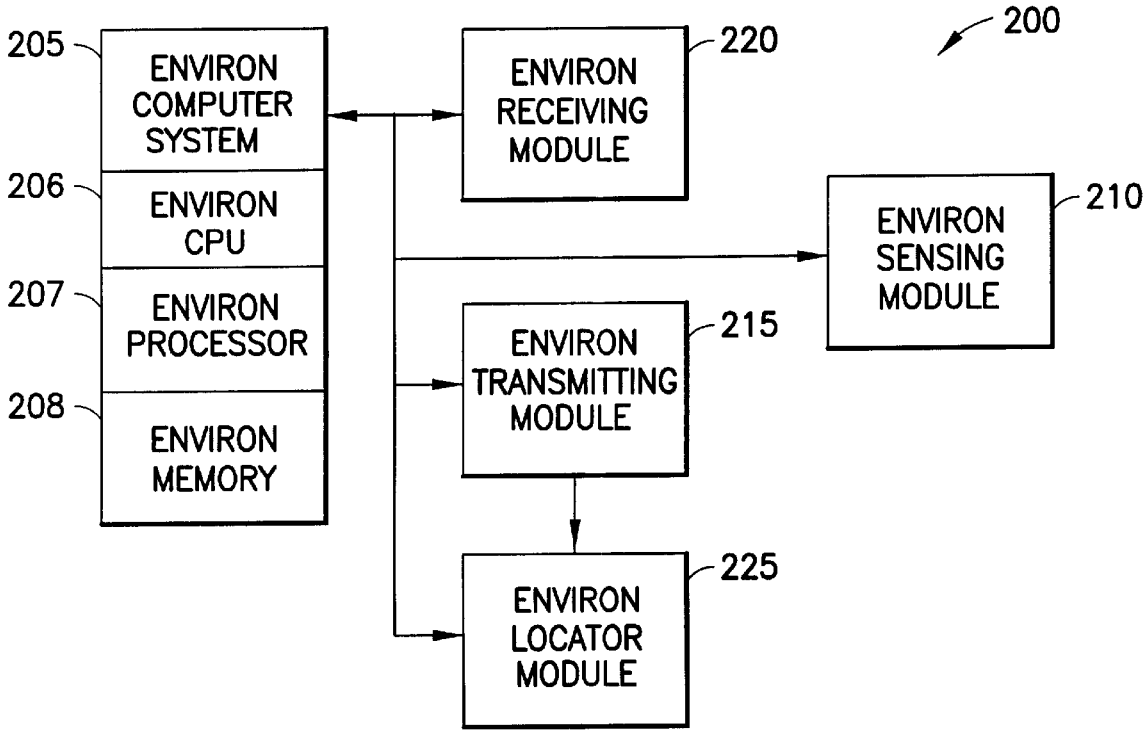
FIG. 2 shows an instance of a generalized embodiment of an environ with the cooperative environ apparatus of the present invention.

In some embodiments the environ has cooperative apparatus shown in FIG. 2. FIG. 2 shows a generalized embodiment of an environ with the cooperative environ apparatus 200 of the present invention. It shows an environ computer 205 having an environ CPU 206, environ processor 207, and environ memory 208. The computer is coupled to an environ sensing module 210, an environ transmitting module 215, and an environ receiving module 220. In some cases the environ apparatus 200 includes an environ locator module 225.

Generally, the environ transmitting module 215 includes an environ transmitting antenna (not shown) and/or environ sensory transmitter (also not shown). The environ receiving module 210 upon receiving an input of interest or import to the environ 200, forwards the signal to the environ processor 207 for processing and determination of the reaction to take in order to protect the special object from the environ and/or the environ from the special object 200. If the situation requires an output, the environ processor 207, causes the environ transmitting module 215 to transmit one or more alarms and/or a signal to the environ. In some situations the transmitting module outputs an audible, visual, electrical, electromagnetic and/or olfactory sensory alarm.

In many embodiments, the environ receiving module 210 includes an environ antenna (not shown) and/or environ sensory sensor (also not shown). The environ sensory sensor senses such things as audio, visual, electrical, electromagnetic and/or olfactory occurrences, alarms and/or indicators.

In many embodiments, the environ transmitting module 215 includes an environ transmitting antenna and/or an environ sensory transmitter. The sensory transmitter directly transmits audio, visual, tactile, pressure and/or olfactory alarms and/or transmits signals to generate these alarms. The signals to generate are transmitted to receiving indicators, displays, and/or one or more a special objects known to be within range of the environ apparatus 200.

When the environ apparatus is generally fixed, its memory includes preprogrammed data on its location. When the environ apparatus is mobile within the environ, the environ locator module 225, generates and/or receives geographic location data of the location of the environ apparatus The location data is used by the environ processor 207 to indicate the location of the environ apparatus 200 to interested parties and/or equipment as the situation warrants. Location data is updated as warranted. The location module 225 includes a Global Positioning System (GPS) or LORAN location determination capability, and/or receives location data from a location indicating device situated in particular environs providing location data. For example in a hospital, or on a commercial airplane, etc., many locations indicating devices are placed indicating their particular location. These devices are either in wired or wireless systems and manners, and emit signals not detrimental to their own environ. In some embodiment a particular protocol is used between the cooperative environ apparatus, (or these location indicating devices) and the special object apparatus 100. It is advantageous to employ a standard protocol known to those skilled in the art.

The environ memory 208 includes information used by the processor 207 to determine import of a reportable phenomenon and environ reaction protocol. It sometimes also stores information about special objects used in reacting to the phenomenon. For example, when the environ is a handicapped individual, the memory stores and makes available descriptive and medical data regarding the individual, i.e. medical problems, medication used and/or allergies.

The environ receiving module 210 upon receiving an input of interest or import to the environ, forwards the signal to the environ processor 207 for processing and determination of the reaction to take to protect the environ from the environ and/or the environ from the environ, or both. If the situation requires an output, the environ processor 207, causes the environ transmitting module 215 to transmit one or more an alarms, and/or a signal to the environ and/or other interested parties. In some situations the transmitting module outputs an audible, visual, electrical, electromagnetic, and/or olfactory sensory alarm.

Figure 3:
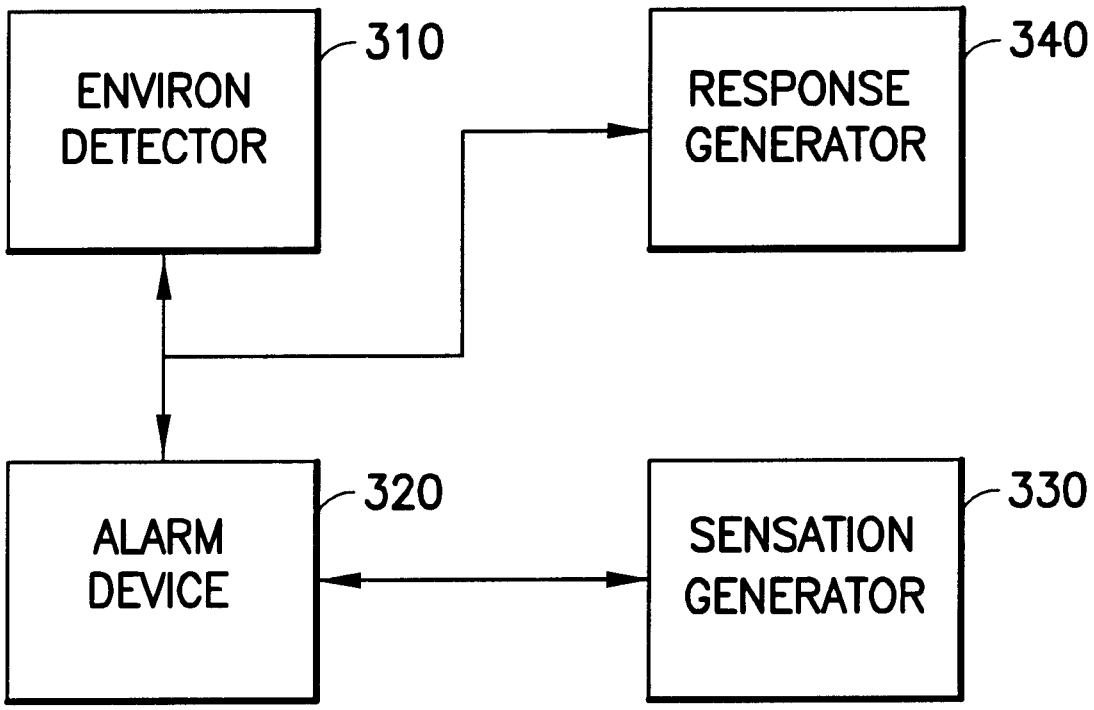
FIG. 3 shows an example deployment of a particular embodiment of the invention as a computerized transmitting telecommunications apparatus.

In a particular embodiment of the invention, an example apparatus is a, generally computerized, transmitting telecommunications apparatus shown in FIG. 3. The apparatus in FIG. 3 includes an environ detector 310 made available to at least one special object [handicapped person, hazardous object, or sensitive equipment]. The environ detector 310 detects a reportable environmental phenomenon. The apparatus also includes an alarm device 320 respondent to the reportable environmental phenomenon, and transmitting an alarm signal that the special object [e.g. handicapped person] is in the environ. It also includes a sensation generator 330 for receiving the alarm signal and generating a particular sensation signal adapted to the special object, e.g., a handicapped person and etc. The apparatus also generally includes a response generator for causing an evasive reaction to be taken to evade the reportable environmental phenomenon. In some cases, some or all of these apparatus elements are with or proximate to the special object. In other cases portions of the apparatus [300] are located with or proximate to a companion or operator of the special object.

Figure 4A:
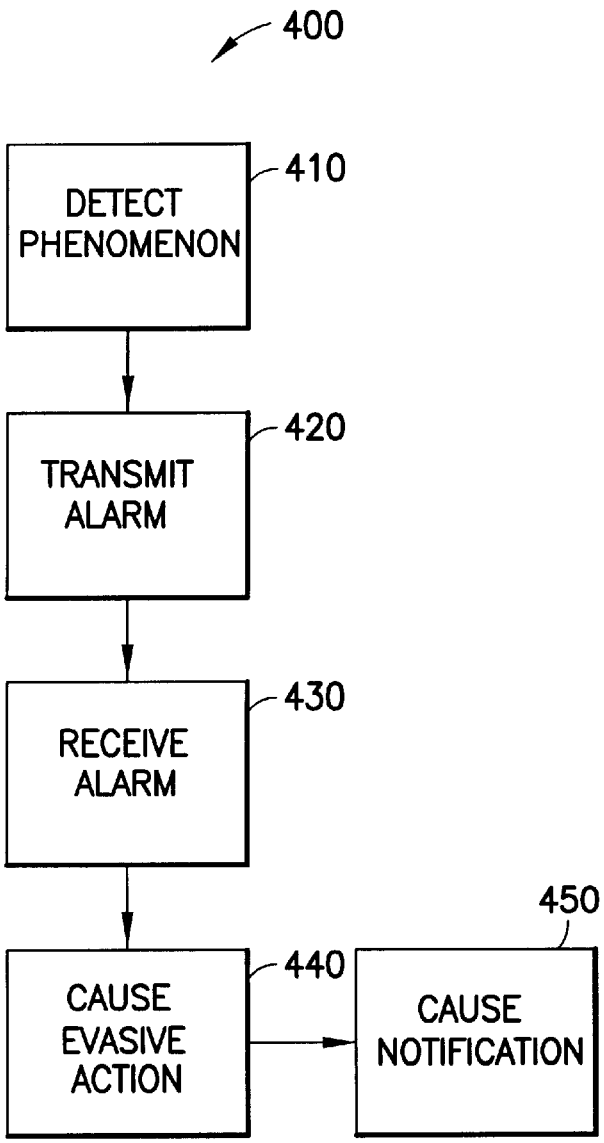
FIG. 4(*a*) shows an example of a flowchart of a method in accordance with the present invention.
Figure 4B:
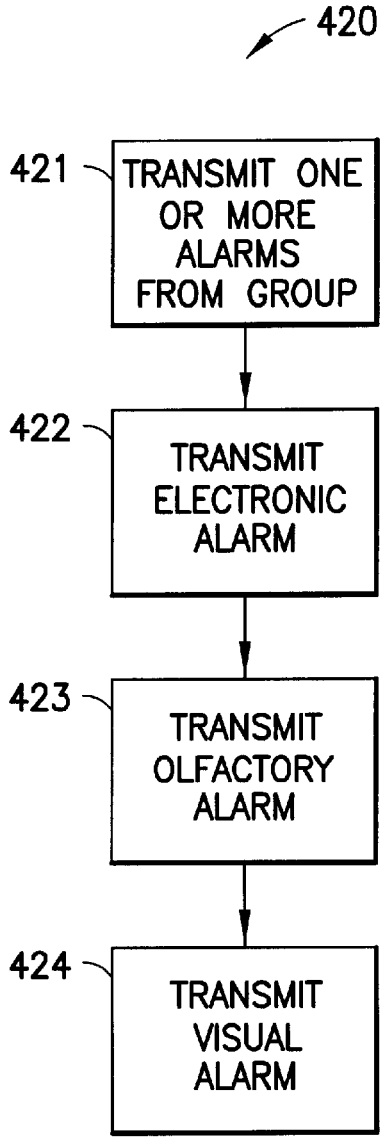

In a particular embodiment of an example method 400 of the invention, shown in FIG. 4(*a*), the method includes the steps of detecting a reportable environmental phenomenon in an environ including at least one special object such as a handicapped person 410; transmitting an alarm signal responsive to said reportable environmental phenomenon indicating that said at least one handicapped person is in the environ 420; receiving said alarm signal and generating a particular sensation signal adapted to said at least one handicapped person 430; and causing an evasive reaction to be taken to evade said reportable environmental phenomenon 440.

In some implementations of the example method 400, the step of transmitting 420 includes transmitting an alarm signal taken from a group of alarm signals shown in FIG. 4(*b*) including: transmitting an audible alarm repeatedly announcing said reportable environmental phenomenon 421; transmitting an electronic alarm reporting said reportable environmental phenomenon to at least one computer 422; transmitting an olfactory alarm corresponding to said reportable environmental phenomenon 423; transmitting an visual alarm corresponding with said reportable environmental phenomenon 424; and any combination of these.

In some implementations of the example method 400, the method further includes notifying the reportable environmental phenomenon and the existence of the at least one handicapped person to others entering or located in the environ 450.

In some cases, the step of causing an evasive reaction is taken by others entering or located in the environ; and/or the step of causing an evasive reaction is taken by the handicapped person or persons, and the particular sensation signal is a signal taken from a group including seeing, hearing, feeling, and/or smelling; and/or the method includes the at least one handicapped person communicating interactively with a responsible reaction agent such as a doctor, medical technician, CPR administrator, police, fire and/or ambulance personnel; and or the responsible reaction agent is a special care entity or anyone in the environ capable of responding.

In an alternate embodiment, the apparatus is a computerized transmitting telecommunications apparatus comprising: an environ detector made available for at least one environ sensitive entity for detecting a reportable environmental phenomenon; and an alarm device responsive to said reportable environmental phenomenon for transmitting an alarm signal that said at least one environ sensitive entity is in the environ, and for generating a particular sensation signal adapted to said at least one environ sensitive entity.

In some cases the computerized transmitting telecommunications apparatus the at least one environ sensitive entity includes a special object including a handicapped person, a cell phone, radioactive material, chemical material, explosive material, dangerous equipment and/or any combination of these. In some cases, the at least one environ sensitive entity includes special equipment.

In another example embodiment, a voice emanating from notification equipment 450 coupled to the special object repeatedly or continuously announces or sets off an audible alarm, visual, olfactory (smell) and/or tactile (touch) signal in vehicles collocated in that environ) Examples of the notification include:

- a deaf person is driving the blue Buick (so your horn is useless); the man in the green overcoat is blind; (so you are not being seen) the lady in the yellow dress is crippled (so needs extra time to cross the street);
- the white truck is carrying radioactive material, or medical material, or is emitting electronic signals, or is carrying a strong magnet (so stay at least 100 feet away, especially if you have a pacemaker);
- the yellow car has break problems and has difficulty to stop;
- a safety vehicle (ambulance, police vehicle, fire vehicle) is approaching your environ; etc.
- a safety vehicle (ambulance, police vehicle, fire vehicle) is leaving your environ; etc.
- the air quality in this environ is below standard; (so stay out or keep windows closed if you have heart or lung problems)
- a magnetic force is operating (or is detected) in this environ; (stay out if you have a pacemaker, an expensive mechanical watch, sensitive equipment, etc.

Some of these embodiments are particularly useful at congested airport, cinema, ballpark, a corporate, governmental or military site and hotel parking areas amenable to receiving and responding to these messages.

Various other embodiments include:

- cooperative dedicated computerized apparatus both with the handicapped individual or special equipment and with persons, objects and/or vehicles entering (or located in) that environ;
  - employing a standard developed to provide (preferably non-irritating) alarm/notification signal to said persons, objects and/or vehicles entering (or located in) that environ;
  - employing a protocol developed to provide (preferably non-irritating) signal to said persons, objects or vehicles entering (or located in) that environs
- dedicated computerized telecommunications apparatus, for the handicapped individual or special equipment outputting an audio or visual signal recognizable by persons, objects or vehicles entering the environ so as to be collocated with handicapped individual or special equipment that environ;
- methods to provide a warning to persons, objects and/or vehicles that a handicapped individual or special equipment (containing medical or radioactive material and/or waste) requiring special attention from and/or by others entering (or located in) that environ, etc.
- apparatus and/or method to identify and make an alarm indication for an emergency vehicle in the environ: ambulance, police vehicle, fire vehicle etc.:

In an embodiment there are (standardized) cooperative systems in all vehicles to indicate (in a plurality of ways) the type of action the receiving vehicle is requested/required to perform: move right, left, pull over, slow down, speedup, proceed with caution, etc.

In an embodiment there is a received signal converter in the receiving vehicle to convert the signal received to a type the driver is sensitive to for example, an audible signal received by a deaf driver is converted into a visual signal.

In an embodiment there is a response required from the receiving person, vehicle and/or object acknowledging receiving the transmitted warning received from the transmitting person, object, vehicle, ambulance, police vehicle, fire vehicle. For example, the blind person is notified that the approaching vehicle acknowledges knowing that a blind person is crossing or wants to cross, and crossing is safe.

In an embodiment there are (standardized) cooperative systems in selective vehicles indicating to Person-1, Object-1 and/or Vehicle-1 that Person-2, Object-2 and/or Vehicle-2 is in the environ.

In a more particular embodiment Person-1, Object-1 and/or Vehicle-1 can program which of a plurality of other Persons-(2 to x), Objects-(2 to y) and/or Vehicles-(2 to z) should cooperate in the cooperative system. In some cases particular pieces of information are automatically (and/or manually) programmed or preprogrammed to be exchanged. In some case, the receiving person, object and/or vehicle may also have sensors to detect particular environ information necessary to be known and/or reacted to by the receiving person, object and/or vehicle.

Any of these embodiments may include exchanging information by pulling/tugging a handicapped person's or accompanying companion or attendant's hand other body part, apparel.

Alternate embodiments include environs having particular properties. These include for example environs which produce or have a high magnetic field emission to which a special object is sensitive. The sensitive special object may be a person with a cardiac pacemaker and/or magnetic sensitive equipment which could become defective or non-operational because of the magnetic field. In one embodiment the environ with the high magnetic field has a special signal emitting transmitter indicating the presence of the high magnetic field, and the sensitive object has a cooperative receiving transmitter capable of receiving the special signal. It is advantageous to use a standard protocol, but some embodiments use a special protocol to provide special desired effects effecting and controlling signal emissions, signal type, signal confidentiality and/or security etc. In some cases the sensitive special object would direct the temporary turning-off of the magnetic field generator. In other cases the sensitive special object would take evasive action to stay out and/or go around the environ with the high magnetic field.

Other examples, include environs which have cell phone use restrictions and or prohibitions. This is the case for example in hospital and some corporate, government, and/or military research complexes. In some embodiments the cell phone has a location module, GPS or otherwise. When the cell phone is activated the location module periodically transmits its geographic location. The cell phone tower uses the geographic location to determine whether to enable restrict or inhibit cell phone reception and/or transmission.

In some simple embodiments the cell transmission sensitive medical or research complex environ continuously or periodically announces or displays the cell phone restriction or inhibition at environ entrance areas. In more capable embodiments, the cell transmission sensitive environ has a cell phone use monitor which upon detection of cell phone use sets off a visual, oral and/or factory or other alarm providing a warning to the cell phone user and/or to special objects or person in the environ. In some cases the special object reacts to the alarm in an evasive and safe manner. Sometimes, the cell system reacts to an alarm signal automatically sensed by apparatus in the cell phone and forward to the cell tower which causes the cell phone to be disabled. In some cases the cell phone is re-enabled when the cell tower receives an all clear message from the sensed alarm. This uses a low level and safe intermittent activation of the cell phone. In some cases this uses a very low frequency cell system alarm protocol or other protocol safe for that environ.

In some cases carriers (trucks, trains, ships and/or airplanes) of special objects are required to continuously and/or periodically emit a signal according to a protocol, which gives information about the special object. The information generally includes special object type, location, description and required precautions [if any]. Thus when a cooperative apparatus at a bridge, tunnel, overpass, underpass senses a truck carrying radioactive or explosive material it can take special precautions. These precautions include for example, sending and/or displaying signals redirecting the truck to a different route, refusing the truck passage, stopping other traffic till the truck passes and/or providing escorts to the truck.

Other embodiments are used for example when the truck, train, ship or airplane is producing a phenomenon detrimental to one or more sensitive objects in a particular environ, the phenomenon is caused to be terminated when in that environ and/or the sensitive object is shielded, deactivated or removed from results of the detrimental phenomenon.

Thus in various embodiments of the present invention, the special object takes evasive action to the phenomenon is directed to be or is deactivated at least temporarily, responsive action is taken to free the special object from the detrimental effects of the phenomenon, responsive actions is taken to help the special object to cope with the phenomenon or with its results.

Other examples include environs that are or include special objects located in or entering which are sensitive to radioactive material, explosive or combustible or combustion producing material. The method and apparatus of the present invention include monitoring, indicating and warning of the presence of these dangers. The dangers may be to the special object, to the environ or a part thereof or to both depending on the application and priority. The alarm would cause the special object to take evasive actions, the danger to be turned-off temporarily while the special object is passing the environ and/or response of protective equipments and/or individuals.

The present invention can be realized in hardware, software, or a combination of hardware and software. A visualization tool according to the present invention can be realized in a centralized fashion in one computer system, or in a distributed fashion where different elements are spread across several interconnected computer systems. Any kind of computer system—or other apparatus adapted for carrying out the methods described herein—is suitable. A typical combination of hardware and software could be a general purpose computer system with a computer program that, when being loaded and executed, controls the computer system such that it carries out the methods described herein. The present invention can also be embedded in a computer program product, which comprises all the features enabling the implementation of the methods described herein, and which—when loaded in a computer system—is able to carry out these methods.

Computer program means or computer program in the present context include any expression, in any language, code or notation, of a set of instructions intended to cause a system having an information processing capability to perform a particular function either directly or after either or both of the following a) conversion to another language, code or notation; b) reproduction in a different material form.

It is noted that the foregoing has outlined some of the more pertinent objects and embodiments of the present invention. This invention may be used for many applications. Thus, although the description is made for particular arrangements and methods, the intent and concept of the invention is suitable and applicable to other arrangements and applications. It will be clear to those skilled in the art that modifications to the disclosed embodiments can be effected without departing from the spirit and scope of the invention. The described embodiments ought to be construed to be merely illustrative of some of the more prominent features and applications of the invention. Other beneficial results can be realized by applying the disclosed invention in a different manner or modifying the invention in ways known to those familiar with the art.

Having thus described my invention, what I claim as new and desire to secure by Letters Patent is as follows:

1. A transmitting telecommunications apparatus comprising:

an environ detector made available for at least one special object said environ detector for detecting a reportable environmental phenomenon;

an alarm device respondent to said reportable environmental phenomenon for transmitting an alarm signal that said at least one special object is in the environ;

a sensation generator for receiving said alarm signal and generating a particular sensation signal adapted to said at least one special object; and a response generator for causing an evasive reaction to be taken to evade or be freed from said reportable environmental phenomenon.

2. An apparatus as in claim 1, wherein the special object is at least one handicapped person, a cell phone, radioactive or chemical material.

3. An article of manufacture comprising a computer usable medium having computer readable program code means embodied therein for causing the elements of an apparatus, the computer readable program code means in said article of manufacture comprising computer readable program code means for causing a computer to effect the apparatus of claim 1.

4. A computer program product comprising a computer usable medium having computer readable program code means embodied therein for causing the elements of a computerized apparatus, the computer readable program code means in said computer program product comprising computer readable program code means for causing a computer to effect the apparatus of claim 1.

5. A method comprising:

detecting a reportable environmental phenomenon in an environ including at least one handicapped person;

transmitting an alarm signal responsive to said reportable environmental phenomenon indicating that said at least one handicapped person is in the environ;

receiving said alarm signal and generating a particular sensation signal adapted to said at least one handicapped person; and causing an evasive reaction to be taken to evade and/or be freed from said reportable environmental phenomenon.

6. A method as in claim 5, wherein said step of transmitting includes transmitting an alarm signal taken from a group of alarm signals including:

transmitting an audible alarm repeatedly announcing said reportable environmental phenomenon;

transmitting an electronic and/or an electromagnetic alarm reporting said reportable environmental phenomenon to at least one interested party and/or equipment;

transmitting an olfactory alarm corresponding to said reportable environmental phenomenon;

transmitting an visual alarm corresponding with said reportable environmental phenomenon; and any combination of these.

7. A method as in claim 5, further comprising notifying the occurrence of said reportable environmental phenomenon and the existence of said at least one handicapped person to others entering or located in said environ.

8. A method as in claim 7, wherein said step of causing an evasive reaction is taken by said others entering or located in said environ.

9. A method as in claim 5, wherein said step of causing an evasive reaction is taken by said at least one handicapped person, and said particular sensation signal is a signal taken from a group including seeing, hearing, feeling, and/or smelling.

10. A method as in claim 5, further comprising said at least one handicapped person communicating interactively with a responsible reaction agent.

11. A method as in claim 5, wherein said responsible reaction agent is a medical care or other responsible entity.

12. A program storage device readable by machine, tangibly embodying a program of instructions executable by the machine to perform method steps for communication, said method steps comprising the steps of claim 5.

13. An article of manufacture comprising a computer usable medium having computer readable program code means embodied therein for communication, the computer readable program code means in said article of manufacture comprising computer readable program code means for causing a computer to effect the steps of claim 5.

14. A transmitting telecommunications apparatus comprising:

an environ detector made available for at least one environ sensitive entity for detecting a reportable environmental phenomenon; and an alarm device responsive to said reportable environmental phenomenon for transmitting an alarm signal that said at least one environ sensitive entity is in the environ, and for generating a particular sensation signal adapted to said at least one environ sensitive entity.

15. A transmitting telecommunications apparatus as recited in claim 14, wherein said at least one environ sensitive entity includes a handicapped person.

16. A transmitting telecommunications apparatus as recited in claim 14, wherein said at least one environ sensitive entity includes special equipment.

17. A transmitting telecommunications apparatus as recited in claim 16, wherein said special equipment is radioactive.

* * * * *

UNITED STATES PATENT AND TRADEMARK OFFICE

CERTIFICATE OF CORRECTION

PATENT NO. : 6,563,426 B1
DATED : May 13, 2003
INVENTOR(S) : Herzberg

It is certified that error appears in the above-identified patent and that said Letters Patent is hereby corrected as shown below:

Column 1,
Line 13, please delete “and/or,” and insert -- and/or --; and

Column 4,
Line 11, please delete “object.” and insert -- object’. --.

Signed and Sealed this

Twenty-fourth Day of February, 2004

JON W. DUDAS
*Acting Director of the United States Patent and Trademark Office*